US009704363B2

(12) United States Patent
Mitchell

(10) Patent No.: US 9,704,363 B2
(45) Date of Patent: Jul. 11, 2017

(54) HUMAN IDENTIFICATION DETECTION SYSTEM, METHOD AND DEVICE

(71) Applicant: Lennie Ray Mitchell, Woodbridge, VA (US)

(72) Inventor: Lennie Ray Mitchell, Woodbridge, VA (US)

( * ) Notice: Subject to any disclaimer, the term of this patent is extended or adjusted under 35 U.S.C. 154(b) by 0 days.

(21) Appl. No.: 14/729,564

(22) Filed: Jun. 3, 2015

(65) Prior Publication Data

US 2015/0364020 A1 Dec. 17, 2015

Related U.S. Application Data

(62) Division of application No. 13/428,543, filed on Mar. 23, 2012, now Pat. No. 9,080,842.

(Continued)

(51) Int. Cl.
*G08B 15/02* (2006.01)
*F41H 11/06* (2006.01)

(Continued)

(52) U.S. Cl.
CPC ..... *G08B 15/02* (2013.01); *F41H 11/06* (2013.01); *F42B 12/36* (2013.01); *F42B 12/40* (2013.01);

(Continued)

(58) Field of Classification Search
CPC ..... F42B 12/36; F42B 12/40; F42B 12/46; F42B 12/50; F42B 23/00; F42B 23/10; F42B 23/14; F42B 23/16; F42B 23/24; G08B 15/00; G08B 15/02; G08B 13/10; F41H 11/06

(Continued)

(56) References Cited

U.S. PATENT DOCUMENTS 3,344,742 A 10/1967 Schnider, Jr.
4,527,150 A * 7/1985 Porat ..... G08B 13/122 340/541

(Continued)

FOREIGN PATENT DOCUMENTS

EP 957330 A 11/1999
GB 2448982 7/2012
WO 9533176 A 12/1995

*Primary Examiner* — James S Bergin

(74) *Attorney, Agent, or Firm* — The Law Firm of Andrea Hence Evans, LLC

(57) ABSTRACT

The invention provides a system, device and method designed to detect, alert and identify unwanted entry into areas by intruders. The invention is also designed to prevent escape from secured facilities. If escape from such a secured facility is realized, the system will identify and mark the intruder or escapee for immediate or later capture by local and or federal law enforcement authorities. The system will accomplish this by mechanical, electronic and chemical means. The system is also designed to be a territory denial system. Although the system will accomplish its means by clandestine deployment, the unseen but known presence of the device will cause a profound psychological block to any would be intruder to a given area that it is deployed in. The devices are deployed below ground just below the surface as a non-lethal landmine and subterranean several feet below ground as an anti-tunneling device.

4 Claims, 9 Drawing Sheets

Related U.S. Application Data

(60) Provisional application No. 61/466,872, filed on Mar. 23, 2011.

(51) Int. Cl.

| | |
|---|---|
| ***F42B 12/40*** | (2006.01) |
| ***F42B 12/36*** | (2006.01) |
| ***F42B 12/50*** | (2006.01) |
| ***F42B 23/16*** | (2006.01) |
| ***F42B 23/24*** | (2006.01) |
| ***F42B 23/00*** | (2006.01) |
| ***G08B 13/10*** | (2006.01) |

(52) U.S. Cl.
CPC ..... *F42B 12/50* (2013.01); *F42B 23/00* (2013.01); *F42B 23/16* (2013.01); *F42B 23/24* (2013.01); *G08B 13/10* (2013.01)

(58) Field of Classification Search
USPC ..... 102/401, 404, 424, 425, 428, 427, 513, 102/502, 512
See application file for complete search history.

(56) References Cited

U.S. PATENT DOCUMENTS

| | | | | |
|---|---|---|---|---|
| 4,690,061 | A | 9/1987 | Armer, Jr. et al. | |
| 5,747,719 | A * | 5/1998 | Bottesch | G08B 13/19608 340/574 |
| 5,753,851 | A | 5/1998 | Jordan et al. | |
| 5,819,124 | A * | 10/1998 | Somner | G08B 13/19632 396/263 |
| 7,261,041 | B2 | 8/2007 | Brock | |
| 7,543,534 | B1 | 6/2009 | Manole et al. | |
| 8,616,132 | B2 | 12/2013 | Drager | |
| 2003/0159572 | A1 * | 8/2003 | Downs, Jr. | B64C 1/1469 89/1.11 |
| 2008/0022919 | A1 | 1/2008 | Ohnstad et al. | |
| 2009/0084284 | A1 | 4/2009 | Martinez et al. | |
| 2010/0089226 | A1 | 4/2010 | Jones et al. | |
| 2010/0265066 | A1 * | 10/2010 | Edelman | A01M 29/00 340/541 |

* cited by examiner

HUMAN IDENTIFICATION DETECTION SYSTEM, METHOD AND DEVICE

RELATED U.S. APPLICATION DATA

This application is a division of non-provisional patent application Ser. No. 13/428,543, filed Mar. 23, 2012, which claims the benefit of provisional application No. 61/466,872, filed Mar. 23, 2011, hereby incorporated by reference.

FIELD OF THE INVENTION

The present invention relates to a mine device which will deploy a non-lethal chemical marker on an intruder to easily identify the intruder.

BACKGROUND OF THE INVENTION

Illegal immigration into the United States is massive in scale. The growing number of illegal aliens is a sign of how dangerously open the US borders are. The presence of millions of undocumented migrants distorts the law, distracts resources, and can effectively create a cover for terrorists and criminals. Immigrants can be classified as illegal for one of three reasons: entering without authorization or inspection, staying beyond the authorized period after legal entry, or violating the terms of legal entry. The consequences of illegally entering the US provides for a fine, imprisonment, or both for any immigrant. Stricter enforcement of the border in cities has failed to significantly curb illegal immigration. Once undocumented migrants enter the US, they can easily blend in with legal US citizens.

SUMMARY OF THE INVENTION

The present invention provides a customized mine device which will deploy a chemical marker such as a dye on escapees, immigrants, criminals and perpetrators providing an identification system for authorities.

An aspect of an embodiment of the invention provides various colors and types of chemical markers, where the color or type of the marker can identify a type of illegal action committed by the perpetrator.

A further aspect of an embodiment of the invention provides the device being connected together in a daisy chain fashion such that the devices can be ignited in a series.

A further aspect of an embodiment of the invention provides the device functioning above ground in the form of a fence, below ground just below the surface as a non-lethal landmine and subterranean and several feet below ground as an anti-tunneling device.

Additional aspects, objectives, features and advantages of the present invention will become apparent from the following description of the preferred embodiments with reference to the attached drawings.

DETAILED DESCRIPTION OF THE INVENTION

Figure 3:
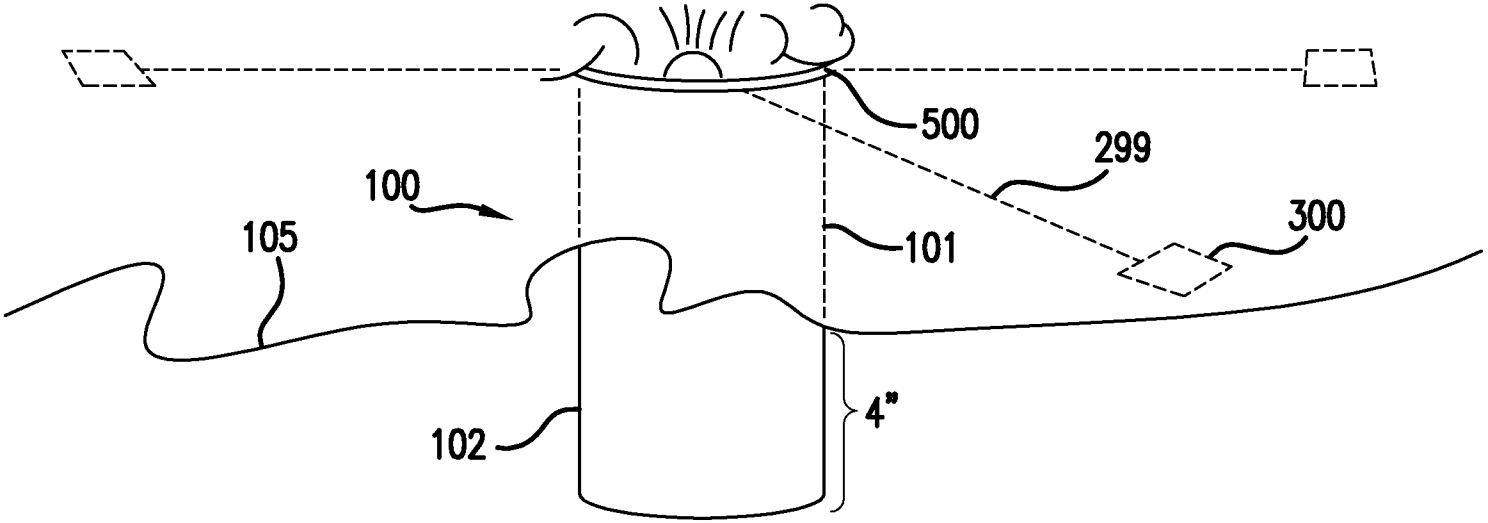
FIG. 3 is a perspective view of the mine device below the surface in a first stage.

FIG. 3 is a perspective view of the Human Identification Detection (HID) mine device 100. The device material features poly-carbon or plastic to avoid detection by metal detectors. The device is weather resistant. The device 100 is a two part cylinder 101, 102 about a foot and a half long. The main housing cylinder is 101 and the inner housing unit is 102. The inner housing unit 102 fits inside of the main housing cylinder 101 and makes up the bottom half of the device. The size of the device may vary depending on the volume of chemicals house and the size of the targeted area. The main housing unit 101 features an open top and open bottom to receive the inner housing unit 102. The bottom half 102 of the device rests in the ground 105 below the surface of the earth at about four inches. The main housing cylinder 100 has four electronic leads 299, shown in FIG. 3 that extend outward from it and are hidden beneath the surface of the ground. Additional or less leads 299 can be added to the device depending on the location of the device or the need to secure an area. The leads 299 are the contacts which allows current to travel through the device. The contacts for the device are disguised as small rocks to camouflage it further. The entire device 100 will be camouflaged to avoid detection by the intruder. FIG. 3 is a perspective view of the mine device below the surface in a first stage. The leads can be various lengths to avoid anticipating when the device will explode. On the end of these leads are electronic sensors 300 that measure weight when stepped upon. The sensors 300 can be designed to trigger the device to an active state. The sensors 300 can be set to trigger the device when a predetermined weight/load is in the vicinity of the sensor or on the sensor. The contacts can be programmed to be weight sensitive to prevent the triggering of the device by animals.

Also contained in the base unit 100 is a processing unit featuring a small electronic motherboard/CPU that is connected to the leads. That motherboard interprets the signals from the contacts. For example, the weight sensor will send signals to the motherboard to activate the device. The motherboard will send signals to the homing units to notify that the mines have been activated. The homing unit can be located at a separate area and monitored so the status of the device may be monitored at all times. The base unit also contains a GPS, radio transponder, and battery to power the unit. The GPS can provide the exact location of the device to monitor the location of the device at all times. The motherboard takes the information from the contacts and interprets it and ignites the charge in the insert tube. The motherboard also sends a signal to a nearby transponder or homing unit that alerts the monitoring station that the device has been triggered. The motherboard is also connected a GPS unit in the device that notifies the transponder and the monitoring station which unit has been triggered. The base unit also has a trigger to ignite the insert unit 102 that is propelled out of the outer housing by an explosive charge. The trigger may also be controlled remotely by the homing unit or activated by the sensors, as discussed above.

Figure 4:
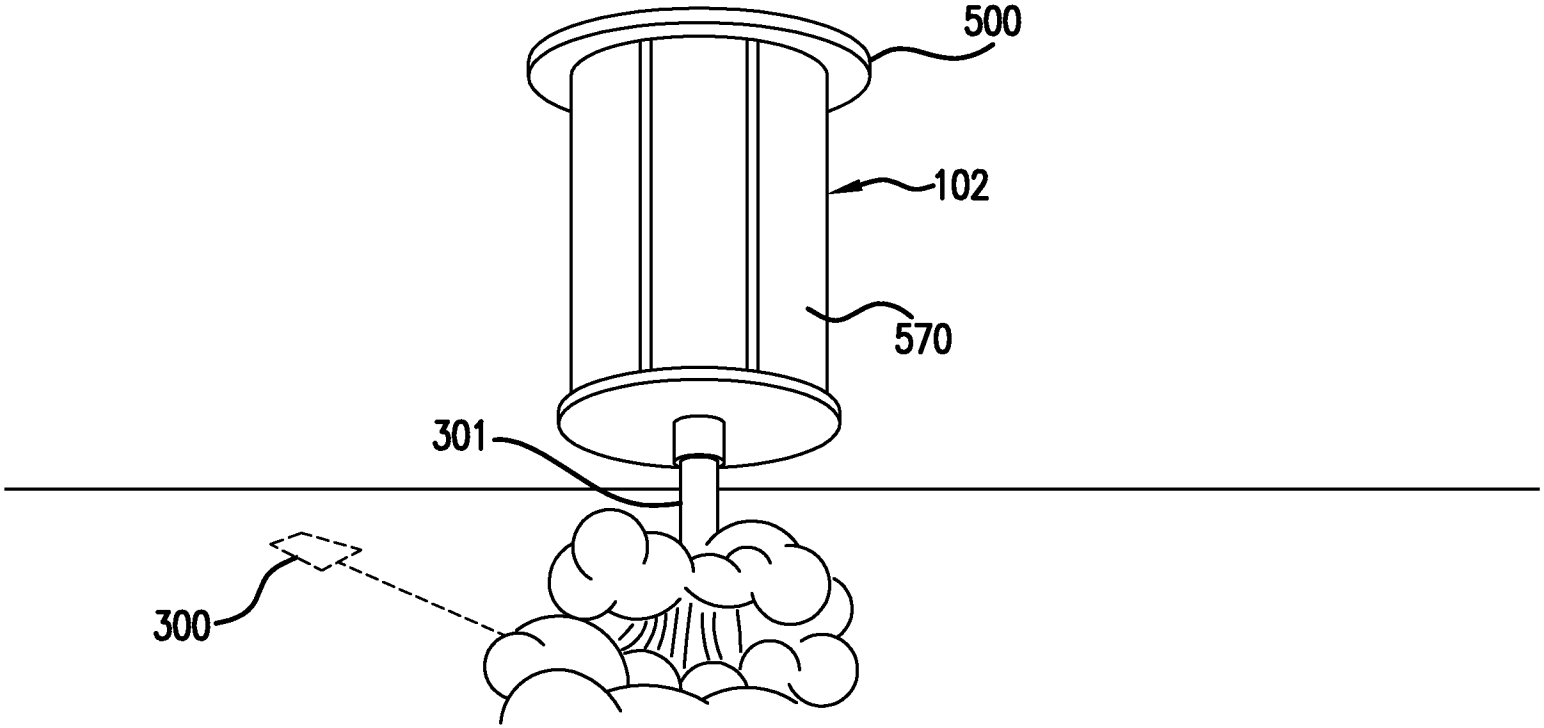
FIG. 4 is a perspective view of the mine device below the surface in a second stage.
Figure 5:
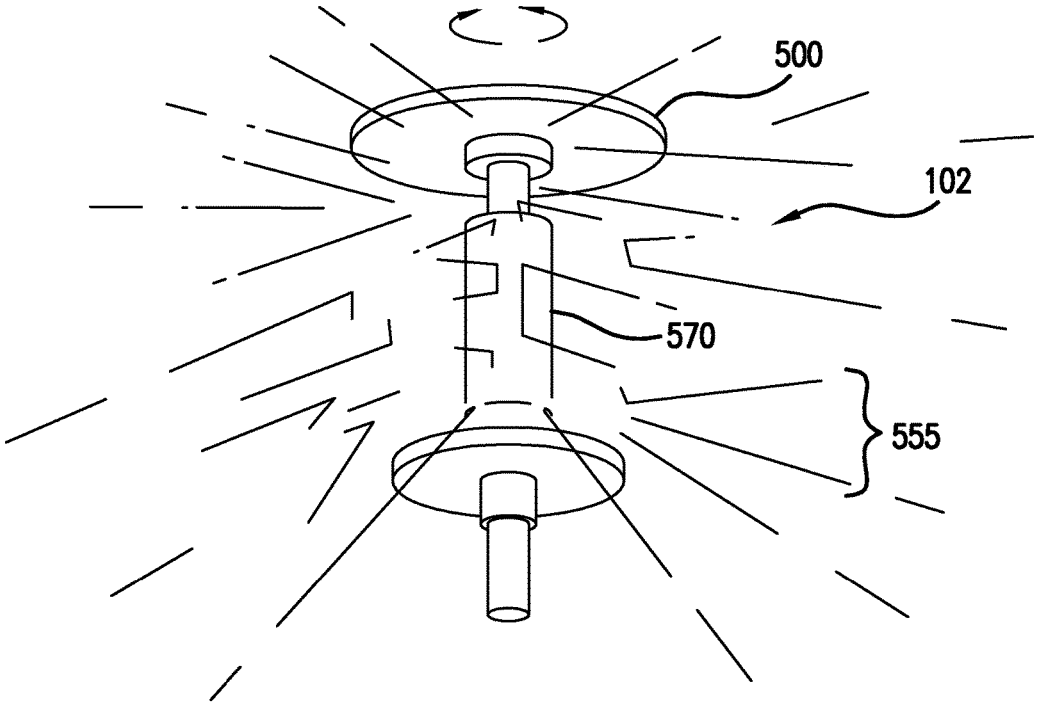
FIG. 5 is a perspective view of the mine device in a third stage.

The inner housing unit 102 acts as a lid for the cylinder. The inner housing unit 102 is disposable and can be recharged with a new engine or power source, explosive charge or chemical bag. The insert lid 500 fits snuggly over the top of the main housing unit 101. The center of the lid has a long tube 301 attached to the center that extends into the center of the housing cylinder 101. In the center of the tube 301 is a propellant that fires the inner housing unit out of the housing cylinder several feet into the air when ignited by the trigger in the base unit, as shown in FIG. 5. The propellant deploys or propels the insert to a predetermined height for maximum effective as shown in FIG. 4. FIG. 4 is a perspective view of the mine device below the surface in a second stage. The inner housing unit 102 has a center tube that will hold the explosive charge or propellant. The first charge will propel the unit at least four feet into the air from beneath four inches of the ground. The second charge will be ignited by the primary charge at the insert's apex of flight. The second charge will explode pushing the concussive force out through slits in the insert center tube impacting and rupturing the plastic pouch, as shown in FIG. 5. As the inserts spins in a counter-clockwise or clockwise fashion, the chemicals contained in the bag will be thrown several feet in all directions, tagging the intruders, escapees or targets. FIG. 5 is a perspective view of the mine device in a second stage. The explosive charge detonates the dye/chemical pack and the chemicals 555 can mark an area of 25 feet in diameter with luminescent biodegradable dyes.

A plastic bag or chemical bag 570 is wrapped around the center tube of the inner housing unit 102. The plastic bag houses a variety of chemical agents. The chemical bag can contain several different chemicals for different missions. The chemicals may be a biodegradable dye that cannot be washed off by soap and water and can only be removed by an engineered compatible chemical key. The dye will contain RFID tags so that individuals can be detected by compatible electronic devices even when concealed or covered by clothing, for example. The tags use a technology that uses radio waves to identify the infraction of the target. The dye will also contain some metallic elements so that it can be detected under clothing by metal detectors. The plastic pouches can also contain pepper spray of tear gas. The pouches will be designed so that they can carry one chemical or a combination of several chemicals. The agent features a chemical marker. The chemical marker contains RFID and metallic elements which allow the dye to be scanned underneath clothing. To remove the dye, a chemical key is required. This may be in the form of an engineered soap or a wipe. The RFID chips when scanned will hold a message based on the location of the device and infraction such as PRISON ESCAPE, FUGITIVE or BORDER VIOLATION, for example. Also, if desired, the dye can be mixed with a pepper spray. The chemical marker will allow easy identification of the perpetrator being in an unwarranted area. When the inner housing cylinder 102 is propelled into the air out of the housing cylinder 101, a second explosion is triggered within the insert tube and is expelled through vents in the insert tube. The tube features vents or openings along its body that allow the chemicals to escape the tube. The small blast ruptures the bag, sending the chemicals in all directions marking the intruders and or escapees. The insert bag is designed to rupture with a minimal amount of force. The chemicals may be color coded such that the colors represent the type of trespass or crime committed. For example, a red dye may represent a PRISON ESCAPE, a blue dye may represent FUGITIVE, etc.

Figure 8:
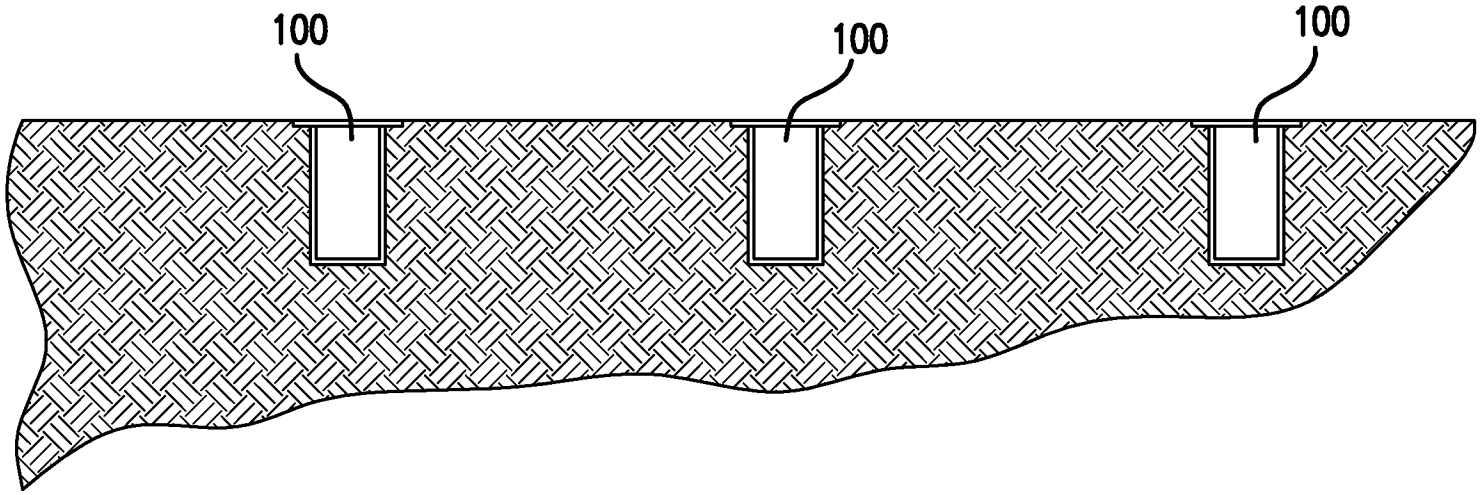
FIG. 8 is a cut away section of a deployment of mine devices in the ground.

The HIDS devices can be triggered individually or in tandem. The devices can be daisy chained together by trading the contacts for electronic connections between two adjoining devices. When one adjoining device is triggered, all attached devices in that series are ignited. FIG. 8 is a cut away section of a deployment of mine devices 100 in the ground which are designed to trigger in tandem or individually.

The device can also be trigged by remote control. An operator can manually trigger the device by a hand held remote that ignites the device. The devices can also be controlled by a central control panel and software. An operator can activate or disable a whole perimeter of HIDS by use of a directly connected panel. Aside from the contacts, the HIDS can be triggered by being connected to a sensor net. The net can replace the individual contacts for each device. The net contains preinstalled contacts. It is then rolled out over a given area and the HIDS are placed into the ground as desired and connected to the net. The net can be connected to a control board or act independently. The net is used for protecting larger areas.

Figure 1:
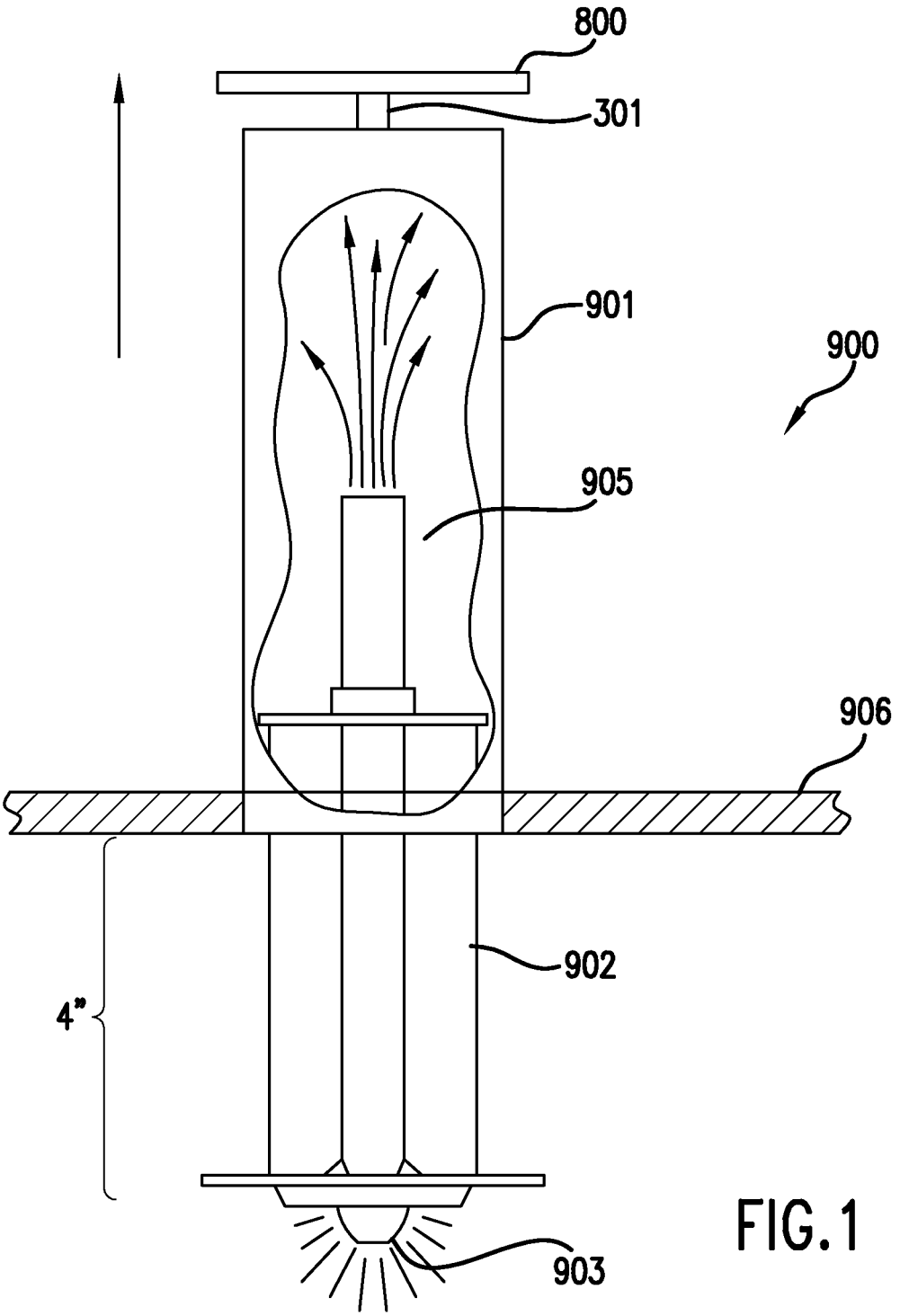
FIG. 1 is a perspective view of the mine device designed to prevent underground tunneling.

FIG. 1 is a perspective view of the mine device 900 designed to prevent underground tunneling. This unit 900 is designed to prevent tunneling underground into or from out of protected facilities or areas. The device is constructed of non-metallic poly-carbon or plastic. The design is completely watertight and weatherproof. It is designed to be buried deep underground, up to about twenty feet. This unit is designed in a similar fashion to the device shown in FIG. 3 but the principle is inverted and will operate several feet underground. The device is in a cylinder shape housing cylinder 901 about one and a half feet long. The top of the unit has a flat base 800 which can be pushed out from the housing cylinder by a spring concealed in the closed top. The base is contracted and held in place by a pin mechanism that is released inside of the housing cylinder 901. The top plate 800 of the device is spring-loaded. The plate is released by a latch that is controlled electronically or mechanically from within the base unit.

The bottom of the housing cylinder 901 is open. The unit has a motherboard within the housing cylinder as well as a GPS, which is used to locate the device at all times, as discussed in the device of FIG. 3. The GPS receives the signal from the motherboard that it has been activated and fired and relays that information and location to the antenna that extends above ground, that in turns sends it to the monitoring station via a field transponder. The antenna extends from the unit to the ground above. The base unit has an ignition system that is triggered by a sensor 903 in the nose of the inner housing cylinder 902. The motherboard receives signals from the sensor at the bottom of the device and relays it to the release latch for the compression spring and it also ignites the propellant and charge in the insert tube.

The second part of the unit is the inner housing unit 902. The inner housing unit is the bottom of the unit. The bottom is curved and has a button sensor 903 extending from it. The bottom fits across the entire diameter of the cylinder. The unit 902 has a long hollow tube 905 attached to its center. That tube contains a propulsion engine and explosive charge. This engine and charge are activated by the motherboard and sensor in the nose of the device. The center of the insert tube is surrounded by a plastic bag that is filled with chemicals whose use and purpose are described above.

A deep cylinder like hole is dug into the ground 906. The device 900 is then placed into the ground at the bottom of the hole with the sensor down 903. The wire antenna is run from the device to the topsoil leaving it exposed. The top of the device which has the pressure plate is still compressed. The hole is then filled with dirt and the weight of the dirt is on top of the device.

When a tunnel is being dug by an intruder or escapee, the intruder loosens the dirt under the HIDS device. The sensor in the bottom of the device is extended and triggers the device. The sensor is pressure sensitive. The motherboard then removes the pin or latch that is keeping the spring compressed at the top of the device. Once pressure is removed from the bottom of the device, the sensor is extended and triggers the actions of the device. The spring is then uncompressed and pushes the device into the tunnel cavity. At the same time, the motherboard then ignites the trigger on the propellant that is attached to the insert.

Figure 2:
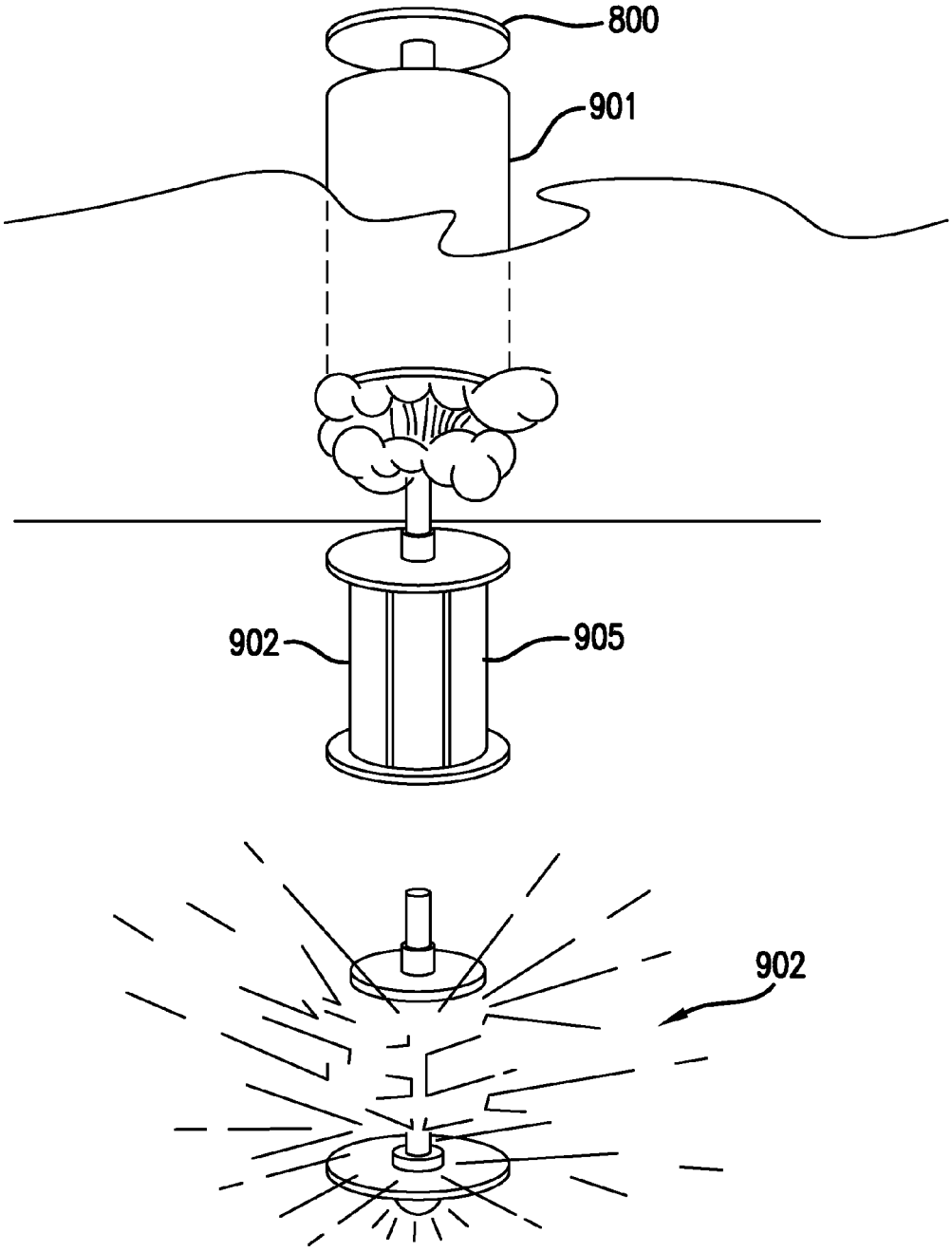
FIG. 2 is a perspective view of a mine device in an active state.

The propellant then fires the insert 902 into the tunnel cavity as shown in FIG. 2. FIG. 2 is a perspective view of the mine device in an active state. The insert contains a bag of chemicals 905 that is fired at the targets in the tunnel cavity. The second ignition to the explosive then ignites sending a concussive force through the support tube of the insert and through the plastic pouch or chemical bag containing the chemicals. The chemicals are dispersed throughout the tunnel marking the targets and possibly collapsing the tunnel. The chemical bag and components are described above. The insert unit has a center tube that will hold the explosive charge or repellant. The first charge will propel the unit at through about a foot of soil into the tunnel. Gravity will assist in moving the unit through a tunnel. The second charge will be ignited by the primary charge at the insert's apex of flight. The second charge will explode pushing the concussive force out through slits in the insert center tube impacting and rupturing the plastic pouch. As the inserts spins in a counter-clockwise or clockwise fashion the chemicals contained in the bag will be thrown several feet in all directions, tagging the intruders, escapees or targets.

Figure 9:
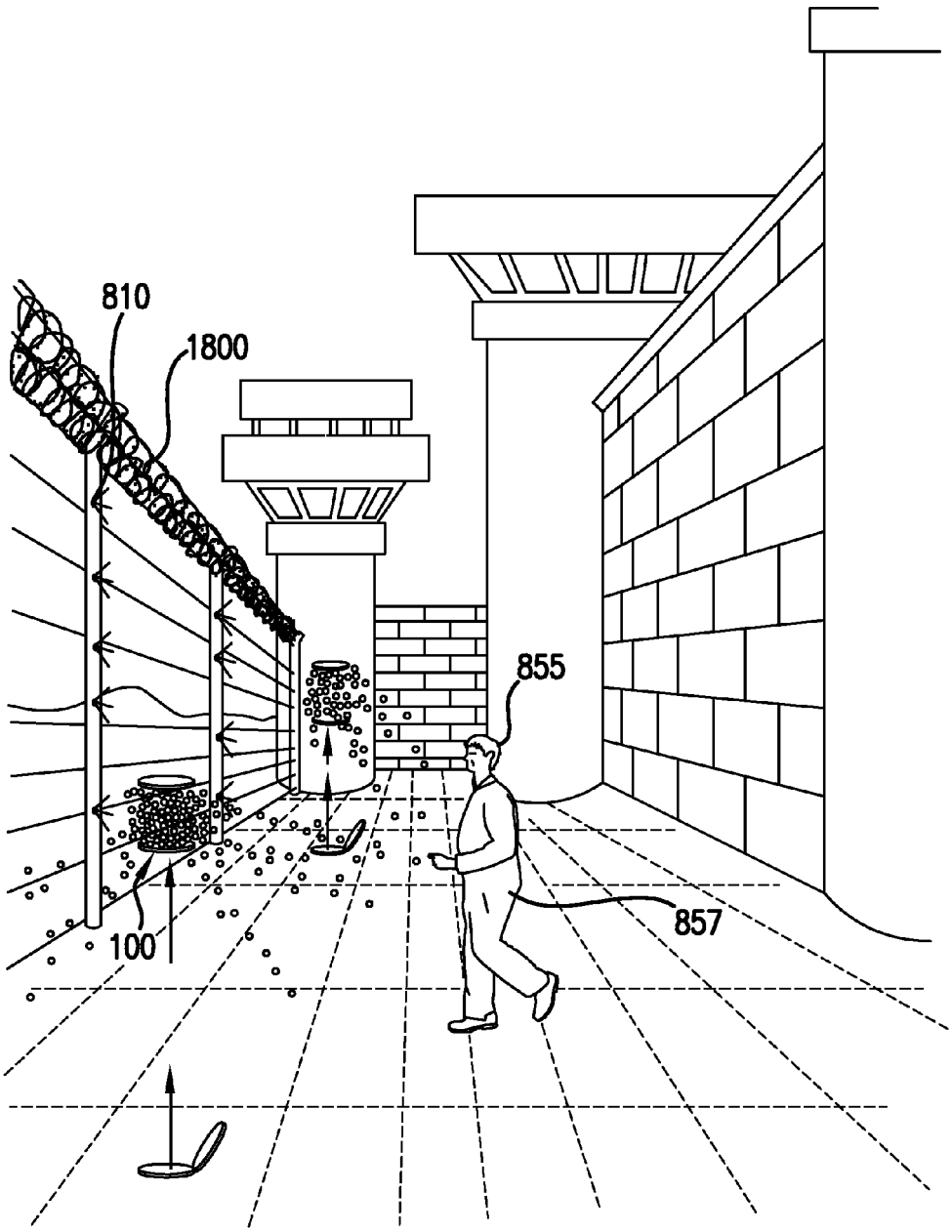
FIG. 9 is an illustration of the device in the form of a fence.

FIG. 9 is an illustration of the device in the form of a fence 1800. The fence 1800 has sensors 810 that detects someone climbing onto it. A sensor system is provided and senses weight or pressure on the links, top and support poles of the fence. The sensors cause the release of a spray of chemicals to mark or disable the intruder or escapee. The chemicals are described above. The fence can be activated or disabled by an operator. The fence is also connected to a security network via software. The fence can also act autonomously. When the intruder climbs the fence, his weight will activate pumps underground that will pump a chemical solution through apertures in the fence poles and on top and cover the escapee/intruder with the chemical solution. The fence will have apertures in the support poles and top rail that will allow the chemicals to flow through and mark anyone that climbs onto it or is in an unwarranted area.

The mix of the chemical solution depends on the facility and mission. Only the section of the fence that is violated will be activated. The fence can be passive or active. It can be triggered manually and it will be connected to the facility security network via software. The fence will notify the facility of intrusion or escape via software at the monitoring station. The fence can be deactivated for maintenance and upkeep or retrieval of an intruder or escapee. When the fence is active, an alarm system activates and notifies the facility of a breach. The devices 100 may be positioned along the fence in the ground and they can activate if the intruder 855 comes within its vicinity. The intruder 855 is shown with chemical markers 857.

Figure 6C:
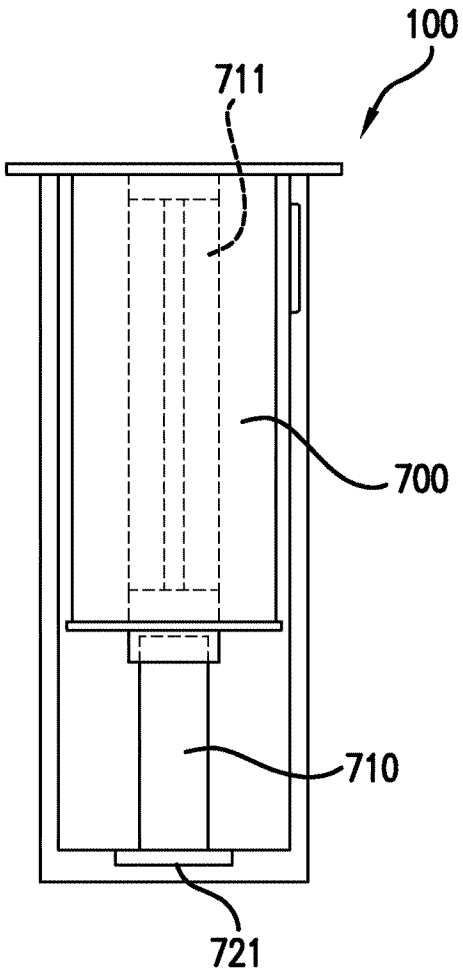
FIG. 6*c* illustrates the main housing unit with full components.
Figure 6B:
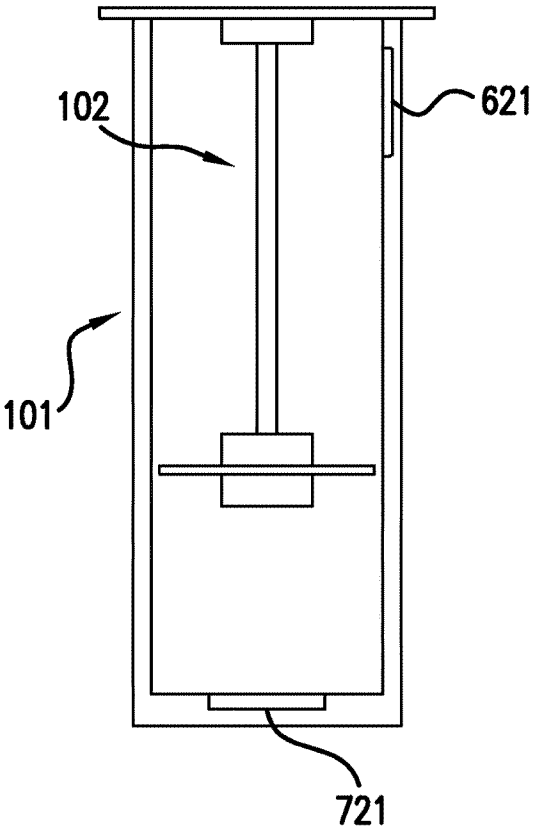
FIG. 6*b* illustrates the outer and inner housing unit of the main housing unit.
Figure 6A:
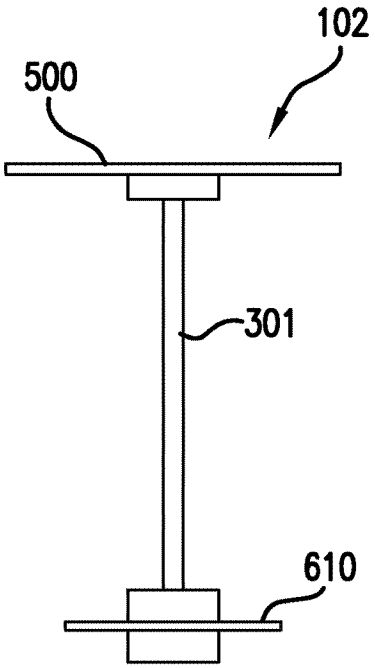
FIG. 6*a* illustrates the inner housing unit of the main housing unit.

FIG. 6*a* illustrates the inner housing unit 102 of the main housing unit 101. The inner housing unit 102 features the insert 500. The insert acts as a lid for the main housing unit cylinder 101. The lid 500 features a central stabilizer tube 301 extending downward. A separation plate 610 fits on the tube 301 and separates the tube 301 and secured dye pack 700 from the A8-5 rocket 710 designed to launch and ignite the explosive 711. The insert unit is disposable and can be recharged with a new engine or power source, explosive charge or chemical bag. The insert lid 500 fits snuggly over the top of the base. The center of the lid has a long tube 301 that extends into the center of the base unit. A detonator 721 such as a mechanical or electrical explosive device or a small amount of explosive is used to initiate the release of the dye.

FIG. 6*b* illustrates the outer 101 and inner housing unit 102 of the main housing unit. The inner housing unit 102 is fitted inside of the outer housing 101. A CPU 621 is positioned between the inner and outer housing units. The processing unit (CPU) controls the device 100, as discussed above. It allows the device to be remotely activated or deactivated. The CPU 621 processes all of the data for the device.

FIG. 6*c* illustrates the main housing unit with full components. The dye pack 700 is wrapped around the tube 301. The rocket 710 is shown underneath the separator plate 610 with the detonator 721 underneath the rocket 710.

Figure 7C:
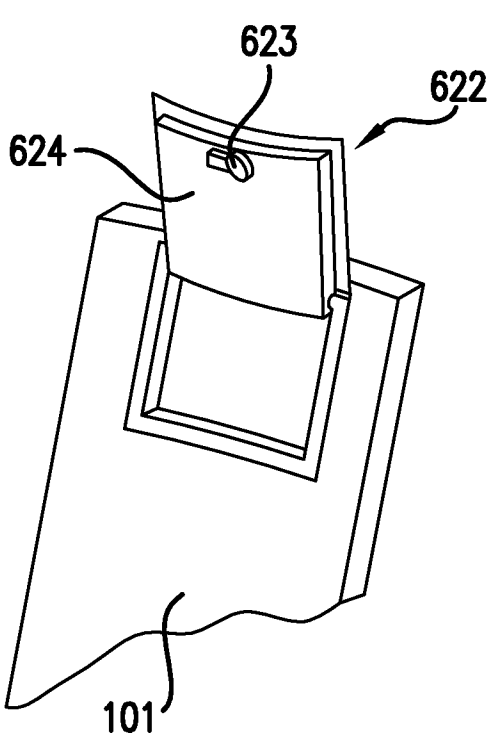
FIG. 7*c* illustrates a door flap on the main housing unit.
Figure 7B:
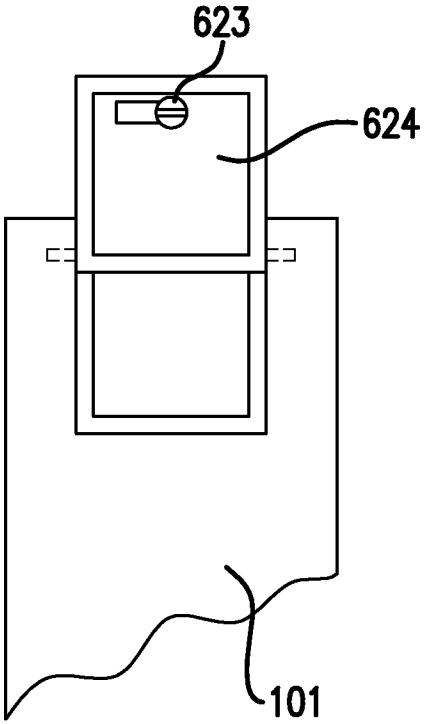
FIG. 7*b* illustrates the CPU protective door in an open position on the inner housing unit.
Figure 7A:
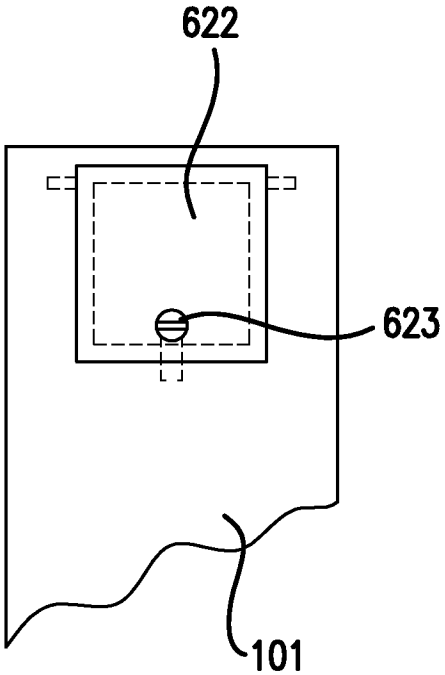
FIG. 7*a* illustrates the CPU protective door in a closed position on the inner housing unit.

FIG. 7*a* illustrates the CPU protective door 622 in a closed position on an inside surface of the main housing unit 101. The CPU 621 is protected by the door 622. The door conceals the CPU from the elements including weather, dust and debris. The door 622 features a screw 623 that functions as a lock. When turned, the screw 623 locks and unlocks the door 622. The door 622 provides access to the CPU 621. The door 622 features an interior seal 624 that adds an extra layer of protection as well as provides a secure fit to ensure the door is sealed and closed. FIG. 7*b* illustrates the CPU protective door in an open position on the main housing unit. FIG. 7*c* illustrates a door flap on the main housing unit.

The device can be used and positioned near nuclear plants, military bases, national borders or any government secured facility, for example.

The invention has been described in detail with particular reference to certain preferred embodiments thereof, but it will be understood that variations and modifications can be effected within the spirit and scope of the invention.

The invention claimed is:

1. A device for identifying and marking a target comprising:

a housing cylinder featuring a processing unit which identifies the location and status of the device;

a spring-loaded top on a top portion of the housing cylinder;

an inner housing unit received by a bottom opening of the housing cylinder;

wherein the inner housing unit is positioned inside the housing cylinder;

wherein the inner housing unit comprises a bottom lid and a tube;

the bottom lid with the tube that extends into a central area of the housing cylinder;

chemicals in the inner housing unit;

a propelling charge for propelling the inner housing unit downward and out of the housing cylinder;

a dispersing charge for dispersing the chemicals;

and a sensor on the bottom lid, wherein when the sensor is activated, the propelling charge causes the inner housing unit to propel downward and the dispersing charge disperses the chemicals.

2. The device of claim 1, wherein the spring-loaded top aids in releasing the inner housing from inside of the housing cylinder.

3. The device of claim 1, wherein the sensor is a pressure sensor which is set to trigger the device when a surrounding area near the device is disturbed.

4. The device of claim 1, wherein the chemicals feature RFID tags that comprise a message which identifies an infraction of the target.

* * * * *